US011127271B2

(12) United States Patent
Piech et al.

(10) Patent No.: US 11,127,271 B2
(45) Date of Patent: Sep. 21, 2021

(54) MULTIPURPOSE AIR MONITORING DEVICE

(71) Applicant: CARRIER CORPORATION, Palm Beach Gardens, FL (US)

(72) Inventors: Marcin Piech, East Hampton, CT (US); Peter R. Harris, Jupiter, FL (US); Michael J. Birnkrant, Wethersfield, CT (US); Michael T. Gorski, Clinton, CT (US); David L. Lincoln, Cromwell, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/973,541

(22) PCT Filed: Apr. 24, 2019

(86) PCT No.: PCT/US2019/028879
§ 371 (c)(1),
(2) Date: Dec. 9, 2020

(87) PCT Pub. No.: WO2020/005375
PCT Pub. Date: Jan. 2, 2020

(65) Prior Publication Data

US 2021/0256826 A1 Aug. 19, 2021

Related U.S. Application Data

(60) Provisional application No. 62/691,761, filed on Jun. 29, 2018.

(51) Int. Cl.
*G08B 17/107* (2006.01)
*G08B 17/117* (2006.01)

(52) U.S. Cl.
CPC ..... *G08B 17/107* (2013.01); *G08B 17/117* (2013.01)

(58) Field of Classification Search
CPC .. G08B 17/107; G08B 17/117; G08B 29/183; G08B 29/26; G01N 21/51; G01N 21/85
See application file for complete search history.

(56) References Cited

U.S. PATENT DOCUMENTS 4,321,466 A * 3/1982 Mallory ..... G01N 21/4785 250/574
4,670,741 A 6/1987 Cole
(Continued)

FOREIGN PATENT DOCUMENTS

CN 204057608 U 12/2014
CN 104732730 A 6/2015
(Continued)

OTHER PUBLICATIONS

International Search Report and Written Opinion for International application No. PCT/US2019/028879 dated Aug. 14, 2019.
(Continued)

*Primary Examiner* — Hoi C Lau
(74) *Attorney, Agent, or Firm* — Carlson, Gaskey & Olds

(57) ABSTRACT

An illustrative example monitoring device includes a plurality of radiation sources that respectively emit a different type of radiation. At least one radiation detector is situated to detect radiation emitted the radiation sources and reflected off airborne particles. The radiation detector has a first sensitivity configured for detecting a concentration of the particles within a first range and a second sensitivity configured for detecting a concentration of the particles within a second, different range. A processor is configured to determine a ratio of the types of detected radiation, a type of the particles reflecting the detected radiation based on the
(Continued)

ratio, and the concentration of the particles reflecting the detected radiation based on the first or second sensitivity.

15 Claims, 3 Drawing Sheets

(56) References Cited

U.S. PATENT DOCUMENTS

| | | | | |
|---|---|---|---|---|
| 5,394,934 | A | 3/1995 | Rein et al. | |
| 5,572,322 | A * | 11/1996 | Noda | G01N 5/02 356/338 |
| 6,125,789 | A * | 10/2000 | Gupta | G01N 15/0205 118/723 E |
| 7,119,900 | B2 | 10/2006 | Okumura et al. | |
| 7,302,313 | B2 * | 11/2007 | Sharp | G01N 1/26 700/275 |
| 7,551,277 | B2 * | 6/2009 | Cole | G01F 1/6842 356/335 |
| 7,564,365 | B2 * | 7/2009 | Marman | G08B 17/103 340/628 |
| 8,115,931 | B2 * | 2/2012 | Miklos | G01N 29/228 356/438 |
| 9,075,007 | B2 * | 7/2015 | McKendree | G08B 17/107 |
| 9,103,805 | B2 | 8/2015 | Gettings et al. | |
| 9,752,974 | B2 * | 9/2017 | Debreczeny | G01N 15/06 |
| 9,903,814 | B2 | 2/2018 | Warren et al. | |
| 10,054,532 | B2 * | 8/2018 | Debreczeny | G01N 15/06 |
| 10,408,730 | B2 * | 9/2019 | Debreczeny | G01N 15/06 |
| 10,989,645 | B2 * | 4/2021 | Coleman | G01N 15/06 |
| 2004/0063154 | A1 * | 4/2004 | Booth | G08B 17/113 435/7.1 |
| 2005/0173635 | A1 * | 8/2005 | Smith | G01N 21/85 250/339.13 |
| 2006/0261967 | A1 * | 11/2006 | Marman | G08B 29/26 340/630 |
| 2007/0261558 | A1 | 11/2007 | Ashworth | |
| 2007/0285264 | A1 | 12/2007 | Cole | |
| 2008/0246623 | A1 * | 10/2008 | Nagashima | G08B 17/107 340/630 |
| 2009/0075248 | A1 * | 3/2009 | Debreczeny | G01N 15/06 435/3 |
| 2011/0188039 | A1 * | 8/2011 | Aoyama | G01N 21/85 356/338 |
| 2012/0194800 | A1 * | 8/2012 | Debreczeny | G01N 21/51 356/51 |
| 2015/0907773 | | 3/2015 | Belinsky et al. | |
| 2015/0253165 | A1 * | 9/2015 | Ajay | G01N 1/24 73/28.01 |
| 2015/0300938 | A1 * | 10/2015 | Debreczeny | G01N 21/51 356/343 |
| 2016/0116181 | A1 | 4/2016 | Aultman et al. | |
| 2016/0178228 | A1 | 6/2016 | Shahabdeen | |
| 2017/0328591 | A1 | 11/2017 | Kelly et al. | |
| 2018/0045635 | A1 * | 2/2018 | Debreczeny | G01N 21/51 |
| 2018/0073982 | A1 * | 3/2018 | Ebata | G08B 17/10 |
| 2019/0017914 | A1 * | 1/2019 | Debreczeny | G01N 15/06 |
| 2019/0339197 | A1 * | 11/2019 | Boutami | G01N 29/032 |
| 2020/0265697 | A1 * | 8/2020 | Gao | G08B 29/183 |

FOREIGN PATENT DOCUMENTS

| | | | |
|---|---|---|---|
| CN | 205274915 | U | 6/2016 |
| CN | 106710151 | A | 5/2017 |
| EP | 3029648 | A1 | 6/2016 |
| WO | 2017178574 | A1 | 10/2017 |
| WO | 2018027104 | A1 | 2/2018 |

OTHER PUBLICATIONS

International Preliminary Report on Patentability for International application No. PCT/US2019/028879 dated Jan. 7, 2021.

* cited by examiner

MULTIPURPOSE AIR MONITORING DEVICE

BACKGROUND

Various air quality monitoring devices are known. Smoke detectors are widely used to monitor the air in an enclosed space or building to provide a warning or alarm when smoke is present. In addition to smoke, there are a variety of contaminants and pathogens that affect air quality and the health of individuals exposed to them. Other types of air quality monitors are less widely used, however, because they are more expensive than typical smoke detectors.

SUMMARY

An illustrative example monitoring device includes a plurality of radiation sources that respectively emit a different type of radiation. At least one radiation detector is situated to detect radiation reflected off airborne particles. The radiation detector has a first sensitivity configured for detecting a concentration of the particles within a first range and a second sensitivity configured for detecting a concentration of the particles within a second, different range. A processor is configured to determine a ratio of the types of detected radiation based on an indication from the detector, a type of the particles reflecting the detected radiation based on the ratio, and the concentration of the particles reflecting the detected radiation based on the first or second sensitivity.

An example embodiment having one or more features of the device of the previous paragraph includes a controller configured to control whether the radiation detector detects the reflected radiation with the first sensitivity or the second sensitivity.

In an example embodiment having one or more features of the device of any of the previous paragraphs, the controller is configured to switch between a first state of operation that includes the first sensitivity and a second state of operation that includes the second sensitivity.

In an example embodiment having one or more features of the device of any of the previous paragraphs, the controller is configured to cause the radiation detector to detect reflected radiation with the first and second sensitivities simultaneously.

In an example embodiment having one or more features of the device of any of the previous paragraphs, the radiation detector has a gain that corresponds to the sensitivity and the controller is configured to control the sensitivity by controlling the gain.

In an example embodiment having one or more features of the device of any of the previous paragraphs, the gain is based on a resistance associated with the radiation detector and the controller is configured to control the sensitivity by controlling the resistance.

An example embodiment having one or more features of the device of any of the previous paragraphs includes an aperture associated with the at least one radiation detector and the aperture limits an amount of the radiation that can reach the at least one radiation detector.

In an example embodiment having one or more features of the device of any of the previous paragraphs, a first one of the radiation sources emits light of a first wavelength, a second one of the radiation sources emits light of a second wavelength, and the second wavelength is different than the first wavelength.

In an example embodiment having one or more features of the device of any of the previous paragraphs, the first one of the radiation sources emits one of blue light, red light and infrared light and the second one of the radiation sources emits ultraviolet light.

In an example embodiment having one or more features of the device of any of the previous paragraphs, the at least one detector comprises a first detector having the first sensitivity and a second detector having the second sensitivity.

An illustrative example method of monitoring air quality includes emitting a plurality of types of radiation, detecting radiation reflected off airborne particles, determining a ratio of the detected types of radiation, determining a type of the particles reflecting the detected radiation based on the ratio, and determining a concentration of the particles reflecting the detected radiation including a first sensitivity for detecting the concentration within a first concentration range and a second sensitivity for detecting the concentration within a second, different concentration range.

An example embodiment having one or more features of the method of any of the previous paragraphs includes selectively controlling use of the first sensitivity or the second sensitivity.

An example embodiment having one or more features of the method of any of the previous paragraphs includes switching between a first state of operation that includes the first sensitivity and a second state of operation that includes the second sensitivity.

An example embodiment having one or more features of the method of any of the previous paragraphs includes using the first and second sensitivities simultaneously.

In an example embodiment having one or more features of the method of any of the previous paragraphs, detecting at least one of the types of radiation includes using a radiation detector that has a gain corresponding to the sensitivity and selectively controlling the sensitivity comprises controlling the gain.

In an example embodiment having one or more features of the method of any of the previous paragraphs, the gain is based on a resistance associated with the radiation detector and selectively controlling the sensitivity comprises controlling the resistance.

An example embodiment having one or more features of the method of any of the previous paragraphs includes detecting the radiation reflected off the airborne particles at the first sensitivity; determining whether a detector is saturated at the first sensitivity by the detecting; when the detector is saturated at the first sensitivity, detecting the radiation reflected off the airborne particles at the second sensitivity, wherein the second sensitivity is lower than the first sensitivity; determining whether a detector is saturated at the second sensitivity by the detecting; and providing an indication when the detector is saturated at the second sensitivity.

In an example embodiment having one or more features of the method of any of the previous paragraphs, a first one of the types of radiation comprises light of a first wavelength, a second one of the types of radiation comprises light of a second wavelength, and the second wavelength is different than the first wavelength.

An example embodiment having one or more features of the method of any of the previous paragraphs includes providing at least one of an indication and an alarm when the determined particle type and the determined concentration satisfy preselected criteria.

In an example embodiment having one or more features of the method of any of the previous paragraphs, a first detector has the first sensitivity and a second detector has the second sensitivity.

Variations and modifications to at least one disclosed example embodiment will become apparent to those skilled in the art from the following detailed description. The drawings that accompany the detailed description can be briefly described as follows.

DETAILED DESCRIPTION

Embodiments of this invention facilitate monitoring air quality including detecting smoke and various other types of particles. A single device that uses different types of radiation and has different sensitivities allows for detecting smoke and other contaminants or pathogens at various concentration levels in an economical manner.

Figure 1:
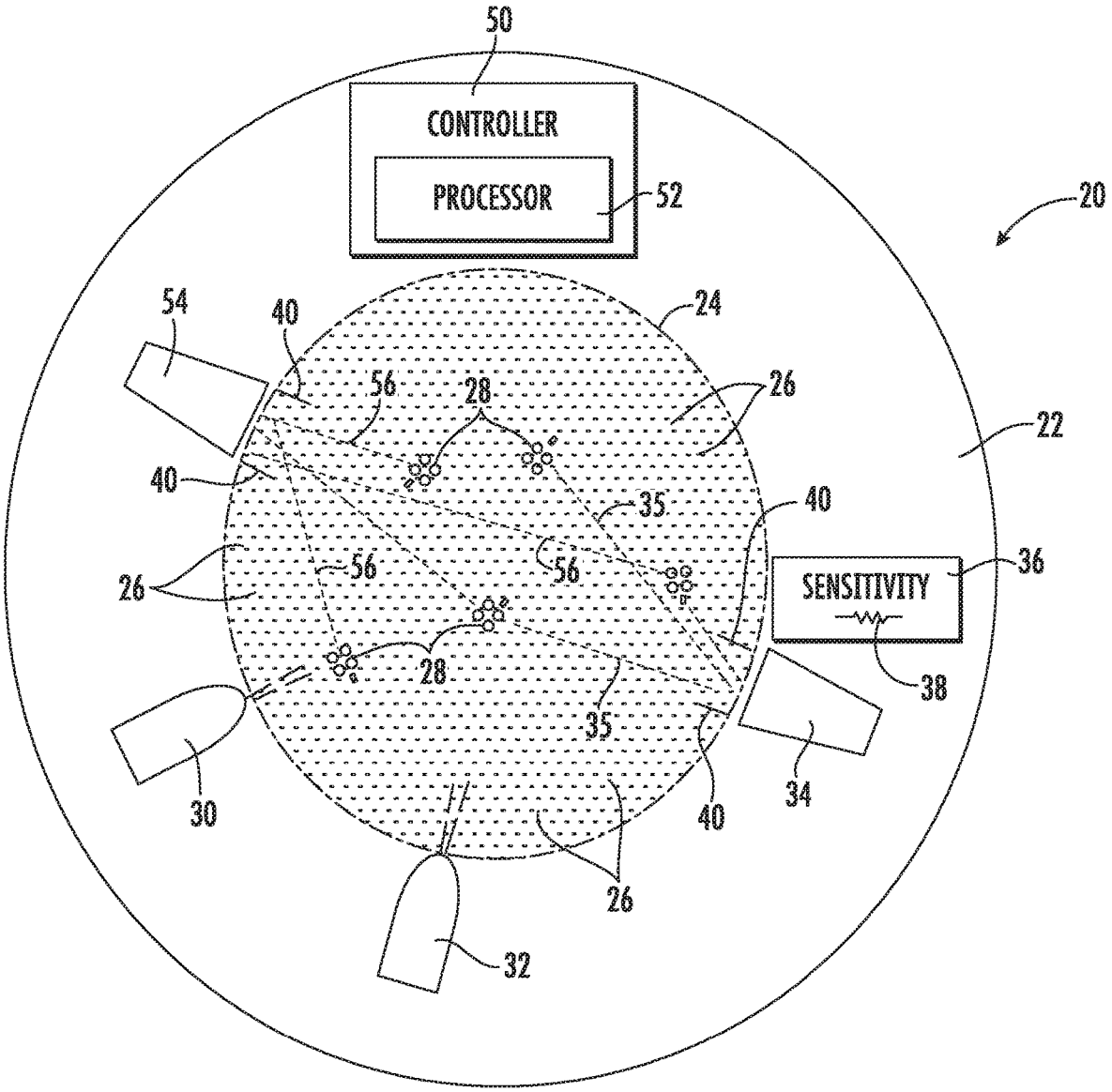
FIG. 1 schematically illustrates a monitoring device designed according to an embodiment of this invention.

FIG. 1 schematically shows selected portions of an example monitoring device 20. This example is configured to operate as a smoke detector and an indoor air quality monitor. The monitoring device 20 is capable of detecting various types of particles within air and to provide information regarding the type of detected particles, a concentration of detected particles, or both.

The example device 20 includes a base or housing 22 that supports a detection chamber 24 and at least partially excludes external radiation. The portions of the housing 22 that define the detection chamber 24 allow for surrounding air to enter the detection chamber 24 where particles 26, 28 can be detected. For discussion purposes, two different types of airborne particles 26 and 28 are illustrated. The example device 20 is capable of detecting more than two different types of particles. In the illustration, the particles 26 are smaller in size than the particles 28 and the concentration of the particles 26 is greater than the concentration of the particles 28.

A first source of radiation 30 is situated to emit radiation into the detection chamber 24. A second source of radiation 32 emits a second, different type of radiation into the detection chamber 24. In an example embodiment, the radiation from the sources 30 and 32 comprises light having different wavelengths. For example, the first source of radiation 30 emits blue light and the second source of radiation 32 emits red light. Other forms of light having different wavelengths may be used in other embodiments for detecting particular types of airborne particles. Some embodiments include ultraviolet light, which allows for detecting fluorescence of some particles. Other embodiments include infrared light.

The monitoring device 20 includes at least one detector 34 that is situated to detect radiation reflected from particles 26, 28 in the detection chamber 24. For illustration purposes, some such reflected radiation from some of the particles 28 is schematically shown at 35. The detector 34 in this example embodiment has the capability of operating with more than one sensitivity. For example, the detector 34 includes an amplification circuit or module 36 that can be tuned or adjusted to change the sensitivity of the detector 34. For example, a resistance 38 associated with the detector 34 provides a different sensitivity, depending on the value of that resistance 38. One example embodiment includes a variable resistance in an amplification circuit for varying or adjusting the sensitivity of the detector 34.

The detection chamber 24 includes shielding features 40, such as apertures, that allow for the reflected radiation 35 to be detected by the detector 34 without allowing too much radiation to the detector 34, particularly when the sensitivity is high. The apertures or shielding features 40 limit the sensing volume or effective field of view of the detector 34. Including an aperture or shielding makes the detector more robust at higher sensitivities and lowers background noise otherwise resulting from scattered light in the detection chamber 24. The shielding features 40 or apertures facilitate using sensitivity levels that allow for single-particle detection.

The example device 20 includes a controller 50 that controls operation of the radiation sources 30, 32 and the sensitivity of the detector 34. The controller 50 includes a processor 52. For discussion purposes, the processor 52 is shown as part of the controller 50. In some embodiments the processor 52 and the controller 50 are distinct components. The processor 52 includes a computing device, such as a microprocessor, and associated memory.

The processor 52 is configured to determine a type of the particles 26, 28 reflecting the radiation within the detection chamber 24. The type of particles in some embodiments includes a specific name or identity for the particles. In other embodiments a classification or generic description of the particles is sufficiently specific to provide information regarding the type of particles. In other words, the level of specificity when determining the type of particles varies among different embodiments.

The processor 52 determines a ratio of the types of radiation in the detected radiation. For example, the particles 28 reflecting the radiation schematically shown at 35 will reflect some of the first type of radiation from the first radiation source 30 and some of the second type of radiation from the second radiation source 32. Different types of particles reflect the different types of radiation differently at a given scattering angle, which is the angle at which the emitted light is deflected by the particles. Some particles will reflect some types of radiation more than others, for example. Determining a ratio of the types of radiation detected by the detector 34 allows for the processor 52 to determine the type of those particles based on the ratio.

There are known ratios associated with particular particle types or sizes and particular types of light that may be used in embodiments of this invention. One example embodiment includes using a relatively low sensitivity setting for smoke detection. The radiation sources 30, 32 emit blue light and infrared (IR) light, respectively, and the processor 52 determines the ratio as a ratio of backscattered blue/IR light. In such an embodiment, the following ratios correspond to different types of particles.

TABLE 1

| Particles | Ratio |
|---|---|
| water fog | 0.2 |
| dust | 0.3 |
| flaming foam | 0.4 |
| liquid flammable | 0.5 |
| flaming wood | 0.6 |
| smoldering wood | 0.7 |
| smoldering cotton | 0.7 |

The same embodiment using a higher sensitivity suitable to detect environmental particles may include detections and the ratios shown in Table 2, which are based on the presence of aerosol oil droplets. The values in Table 2 correspond to a droplet concentration on the order of 55 μgrams/m$^3$. The type of particle identified in Table 2 is based on the size of the droplets.

TABLE 2

| Droplet size | Ratio |
|---|---|
| 1 micron | 0.75 |
| 2 micron | 0.5 |
| 3 micron | 0.3 |
| 4 micron | 0.3 |

Another example embodiment includes a high sensitivity setting for discriminating between pathogens and other environmental particles. In this example, the radiation sources 30, 32 emit ultraviolet (UV) light and red light, respectively. The UV light may induce fluorescence of certain particles. In one such example, the UV light has a 375 nm wavelength and the red light has a 658 nm wavelength. With a particle concentration on the order of 1680 μgrams/m$^3$, the ratios of backscattered red/UV light in Table 3 show how the device 20 of this embodiment is capable of determining whether detected particles are dust or a fungal spore, such as Bruton's Tyrosine Kinase (BTK).

TABLE 3

| Particle Type | Fluorescence (relative) | Scattering (relative) | Ratio |
|---|---|---|---|
| dust | 1 | 200 | 0.005 |
| BTK | 10 | 200 | 0.05 |

The concentration of particles that can be detected depends on the sensitivity of the detector 34. The controller 50 in some embodiments adjusts or switches the sensitivity of the detector 34 between at least a first sensitivity for detecting a concentration of particles within a first concentration range and a second sensitivity for detecting a concentration of particles within a second, different range. In the illustrated example embodiment, one of the sensitivities is selected or tuned for purposes of detecting smoke particles, which are typically present at a relatively high concentration, and the other sensitivity is selected or tuned for detecting another airborne contaminant or pathogen, which is typically present at much lower concentrations.

For example, the device 20 can be set to detect smoke and provide an alarm at a smoke concentration exceeding~3% obscuration/foot, which is roughly equivalent to greater than 10,000 μg/m$^3$. The sensitivity for other environmental particulates, such as dust or pathogens, has to be different. For example, dust may be present at concentrations of interest or concern that are less than 250 μg/m$^3$. Having a higher sensitivity than that used for smoke detection allows for detecting such a lower concentration and providing an indication or alarm when appropriate. By including more than one sensitivity, the device 20 is capable of providing an alarm or indication upon detecting smoke particulates and other airborne contaminants, which is more versatile compared to a standard smoke detector that is only capable of providing an alarm upon detecting smoke.

Embodiments of this invention allow for detecting and discriminating among airborne particulate matter (PM) in the PM 2.5 and PM 10 categories. Given this description, those skilled in the art will be able to select appropriate detector sensitivities for detecting types of particles that are of interest for a given situation based on the ratio of the types of radiation detected.

In one example, the controller 50 controls the gain of the amplification circuit 36 of the detector 34 for purposes of controlling the sensitivity. In one example embodiment, the controller 50 controls the resistance 38 to have different values to adjust or switch the gain to achieve the first and second sensitivities, respectively.

In some examples, the controller 50 or the detector 34 includes an analog-to-digital converter that has a dynamic range that is large enough to allow for operating the detector 34 in a manner that includes simultaneously using the first and second sensitivities.

In the example of FIG. 1, a second detector 54 is situated for detecting reflected radiation from the particles 26, 28 as schematically shown at 56. In this example, the detector 34 operates with a first sensitivity and the detector 54 operates with a second, different sensitivity. Using two detectors 34, 54 is another way of detecting using both sensitivities simultaneously.

In examples where the radiation from the sources 30, 32 comprises light, the detectors 34, 54 comprise photo detectors or photo cells. One example embodiment includes adjusting the sensitivity of at least one of the detectors 34, 54 and adjusting the amount of intensity of light or other radiation provided by at least one of the sources 30, 32. For example, when the sensitivity of a detector is high, the amount of light or other radiation used for particle detection may be reduced to avoid saturating the detector.

Figure 2:
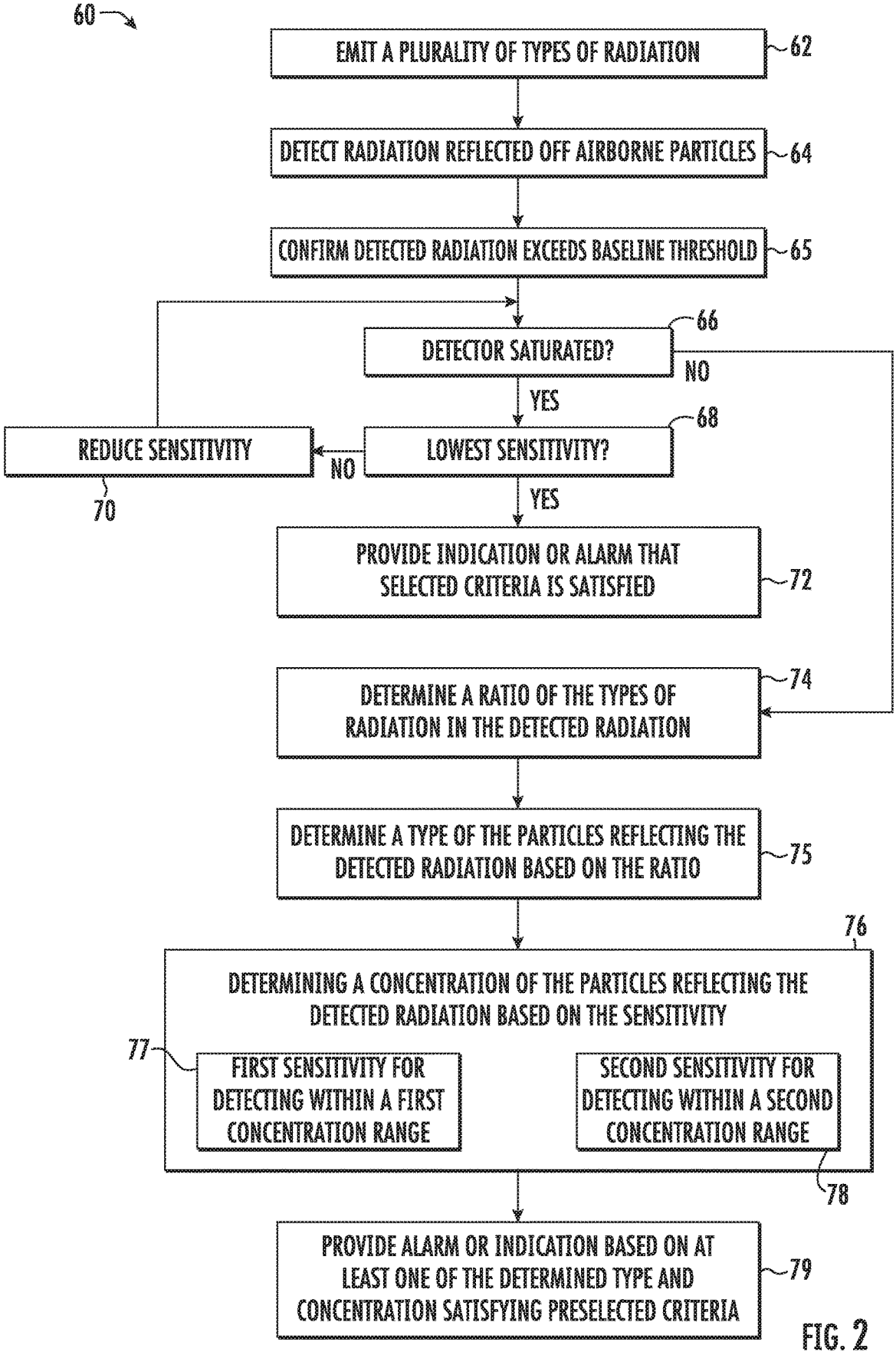
FIG. 2 is a flowchart diagram summarizing an example air monitoring method designed according to an embodiment of this invention.

FIG. 2 includes a flowchart diagram 60 that summarizes an example method of monitoring air quality. At 62, a plurality of types of radiation are emitted, by the sources 30 and 32, for example. At 64, at least one of the detectors 34, 54 detects radiation reflected off airborne particles in the detection chamber 24. The detected radiation in some embodiments has to be above a baseline threshold to avoid using noise for potential particulate detection.

Assuming the detected radiation signal from the detector 34, 54 is above the baseline threshold, the example method continues at 66 where the processor 52 determines whether the detector providing the indication of detected radiation is saturated. A saturated detector would provide information that would prevent a reliable ratio determination for determining the type of particulates reflecting the detected radiation. In this example, the detection begins using a high sensitivity useful for detecting dust or pathogens at relatively low concentrations. Assuming the detector is saturated at that sensitivity, the processor 52 determines whether a lower sensitivity is available at 68. If so, the controller 50 reduces the sensitivity at 70 and the processor 52 then determines if the detector is still saturated at the lower sensitivity. If the detector remains saturated even when the lowest sensitivity is reached, at 72 the device 20 provides an indication, such as an alarm for example, that particulates are present but the device is unable to determine the type of particulates.

Assuming that the detector 34, 54 was not saturated at the initially used sensitivity or is no longer saturated after at least one sensitivity reduction at 70, the processor 52 determines a ratio of the types of radiation at 74 and uses the determined ratio to determine the type of particles at 75.

At 76, the processor 52 determines a concentration of the particles that reflected the radiation based on the sensitivity of the detector 34 or 54 that provides the indication of detected radiation. In this example the first sensitivity is used at 77 for detecting a concentration of the particles, such as the particles 26, within a first concentration range. For example, the first range provides a higher sensitivity that is tuned or selected to allow for detecting airborne particulates that may appear at relatively low concentration levels. The second sensitivity is used at 78 for detecting a concentration of particles, such as the particles 28, within a second, different concentration range. In the illustrated example, the second sensitivity is selected for detecting higher concentrations of particulates at relatively higher levels like that used for detecting smoke.

The processor 52 determines the type and concentration of particles and then uses information regarding preselected criteria to determine whether an indication or alarm is appropriate (e.g., at a particulate concentration exceeding 3% obscuration/ft a smoke alarm could be activated or at a concentration exceeding 500 grams/$m^3$ of pollen a high pollen indication could be provided) When conditions satisfy such criteria, the controller 50 provides at least one of an indication or an alarm at 79. The indication or alarm may be an audible sound emitted by the device 20 or a signal communicated to another device that provides at least one of an audible or visual indication of the detected or determined air quality condition. In some examples, different sounds emitted by the device 20 indicate different conditions. In some examples the device 20 provides an indication that includes information regarding the type and concentration of detected particles. The information regarding the type of particles is specific in some embodiments and more generic in others. For example, some embodiments provide information regarding a distinct identifier or name of the particles while other embodiments provide information regarding a class or range that includes the detected particles.

For example, the controller 50 or processor 52 has information available to it regarding different levels of concentration for different contaminants or pathogens, such as pollen, dust or other particles that may be present at different concentrations. One example includes a database or look up table of ratios, such as those in Tables 1-3 above and concentrations that are of interest or concern and should be reported through an indication or alarm.

If the ratio of the detected types of radiation indicates a specific type of particle and the determined concentration is within a range that is of concern for that type of particulate matter, then the controller 50 instigates an alarm or indication. As the device 20 is capable of detecting various types of particles at different concentration levels, different alarms or indications are provided depending on that which has been detected.

For example, a ratio of blue light to infrared light provides an indication of a type of the particles reflecting the detected radiation. There are known ratio relationships for making such a determination and those skilled in the art who have the benefit of this description will be able to configure a monitoring device to provide the particle type information based on such ratios. An example embodiment includes using such ratio information to discriminate between smoke and other contaminant particles such as particulate matter (PM) in the PM 2.5 and PM 10 categories.

After determining the particulate type, whether specific or generic, detector sensitivities are used to provide concentration information based on signal level. Some embodiments provide the capability of discerning between six different concentration levels. Table 1 below shows one example set of six different concentration levels or ranges that may be determined using a monitoring device like the example embodiment of FIG. 1.

TABLE 4

| Air Quality Index (AQI) Category | μg/$m^3$ - 24 hour average |
|---|---|
| Good | 0.0-12.0 |
| Moderate | 12.1-35.4 |
| Unhealthy for Sensitive Groups | 35.5-55.4 |
| Unhealthy | 55.5-150.4 |
| Very Unhealthy | 150.5-250.4 |
| Hazardous | 250.5-500 |

The alarm or indication provided by the device 20 in some embodiments includes an indication of the AQI category depending on the type of detected particles and the corresponding concentration level(s).

Figure 3:
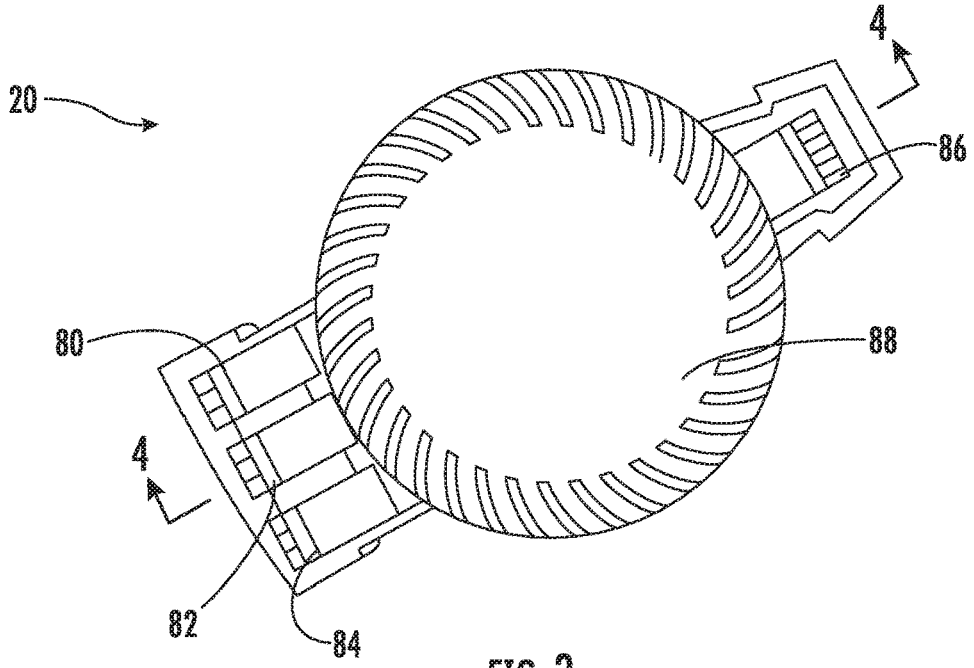
FIG. 3 schematically illustrates another example embodiment of a monitoring device.

FIG. 3 shows an embodiment of an air quality monitoring device 20 that includes three radiation sources 80, 82, 84. In one example embodiment, the radiation source 80 comprises a red LED that emits red light, the radiation source 82 comprises a blue LED that emits blue light and the radiation source 84 emits UV light. Some particle types, such as BTK mentioned above, fluoresce in UV light. The device allows for detecting the fluorescence of such particles by detecting the fluorescence emission from particles on the detector 86. Multiple LEDs are useful for classifying particles by type or class. As an example, UV light and blue LED signals are used for determining a ratio. The ratio is related to the radiation reflected by particles, which is a characteristic used for identifying a type of such particles as mentioned above. A detector 86 is situated for detecting radiation reflected by particles within a detection chamber 88. This example device 20 includes at least one feature for controlling an amount or intensity of the radiation within the detection chamber 88 to avoid saturating the detector 86 when the detector 86 has a relatively high sensitivity.

Figure 4:
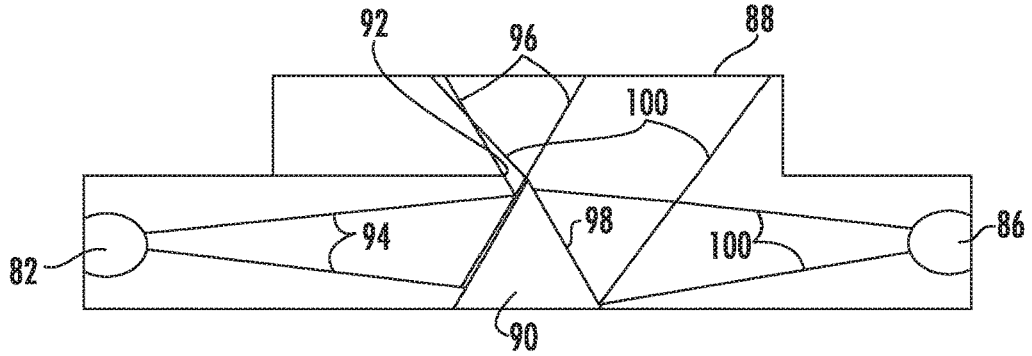
FIG. 4 is a cross-sectional illustration taken along the lines 4-4 in FIG. 3.

FIG. 4 schematically illustrates an interior of this example embodiment, which includes an optical block 90 that reflects radiation into the detection chamber 88. An aperture 92 includes an opening that restricts the amount of radiation reflected into the detection chamber 88. For example, the aperture 92 comprises an opening through a panel situated adjacent the optical block 90 so that radiation within an emission cone 94 from the source 82 enters the detecting chamber 88 only through the aperture 92. This provides a relatively smaller emitting cone 96 within the detection chamber 88 compared to one that does not include an aperture 92 or other element for restricting the amount of radiation entering the chamber 88.

The reduced amount of radiation in the detection chamber 88 limits the amount of radiation that can reflect off a surface 98 of the optical block 90 and be received or detected by the detector 88. In the example of FIG. 4, there is a receiving cone 100 that has a scope or size dependent on or corresponding to the size of the aperture 92 and the emission cone 96 within the detection chamber 88.

Figure 5:
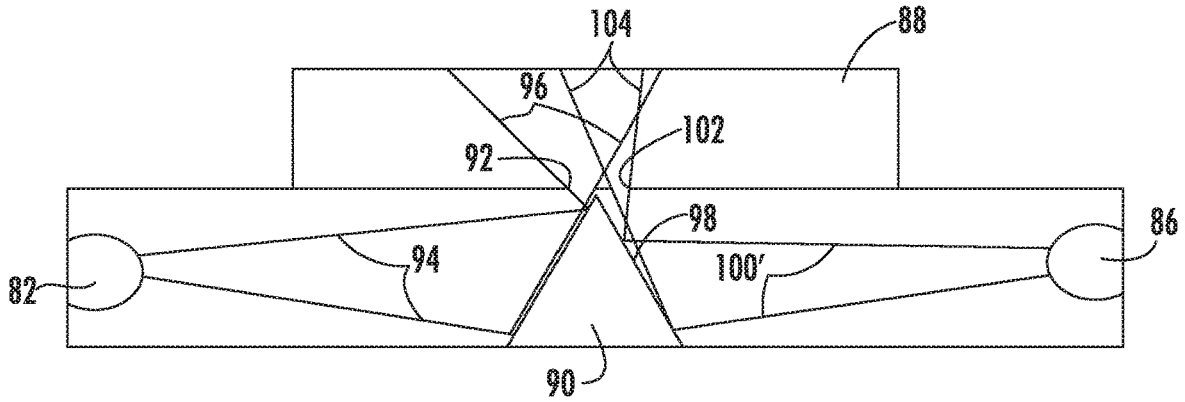
FIG. 5 is an illustration similar to FIG. 4 of another example embodiment.

In another example embodiment illustrated in FIG. 5, a second aperture 102 reduces the amount of radiation reflected from particles in the detection chamber 88 that can reach the reflecting surface 98 of the optical block 90. In this example, the detector 86 has a corresponding receiving cone 100'. As can be appreciated by comparing FIGS. 4 and 5, the receiving cone 100' is smaller than the receiving cone 100. In the example of FIG. 5, the aperture 102 limits the amount of reflected radiation that may be detected by the detector 86 as schematically shown at 104.

Other embodiments include variations, such as including the aperture 102 without the aperture 92. Some embodiments include the ability to change the size or effect of an aperture, for example, by including a lens or other optical element that is selectively situated relative to an aperture. For example, receiving or emitting cones are changed by differently shaped lenses characterized by different focal lengths. The change in focal length changes the receiving cone geometry or emission cone geometry or the light collection properties of the aperture. Any of these factors impact the detecting region, which impacts sensitivity of the detector to particulates. In one example the lens can be a deformable lens. The deformable lens can be composed of piezo-electric polymers or liquid crystals.

The example apertures 92 and 102 provide a relatively smaller area through which light or other radiation may pass compared to the area within known smoke detectors. An average smoke detector has a detection element size on the order of 4 mm and the area through which the detecting light may pass is on the order of 4 mm. In example embodiments of this invention, an aperture, such as the apertures 92 and 102, will be no greater than 0.6 mm in width or diameter. Some embodiments include an aperture having an opening dimension of 0.5 mm and others include apertures as small as 0.025 mm With an aperture designed according to an embodiment of this invention it is possible to use various sensitivity levels to detect different airborne particulates while avoiding saturating the detector. For example, a smaller aperture allows less radiation to reach the detector and that allows the detector to operate with a higher sensitivity over a wider range of concentrations without being saturated.

One example embodiment includes using a sensitivity for air quality monitoring and when some particles are detected, switching or adjusting the sensitivity to a level for detecting smoke to discern whether a smoke alarm or warning signal should be provided. This approach is illustrated in FIG. 2, for example where higher sensitivities are used initially and lower sensitivities are when a detector is saturated at a higher sensitivity. This could occur when smoke is present at a concentration that would result in saturating a detector at a high sensitivity but not at a lower sensitivity appropriate for smoke detection. Other embodiments include switching between the sensitivities for air quality monitoring and smoke detection on a regular, scheduled basis.

Embodiments of this invention allow for achieving smoke detection capability and indoor air quality monitoring capability within a single device. Embodiments of this invention provide devices that are relatively low cost like smoke detectors while providing indoor air quality monitoring capability that is typically associated with much more expensive devices.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A monitoring device, comprising:

a plurality of radiation sources that respectively emit a different type of radiation;

at least one radiation detector situated to detect radiation emitted by the radiation sources and reflected off airborne particles, the at least one radiation detector having a first sensitivity configured for detecting a concentration of the particles within a first range and a second sensitivity configured for detecting a concentration of the particles within a second, different range; and a processor that is configured to determine a ratio of the types of radiation in the detected radiation based on an indication from the radiation detector, a type of the particles reflecting the detected radiation based on the ratio, the concentration of the particles reflecting the detected radiation based on the first or second sensitivity, saturation of the detector at the first sensitivity by detecting the radiation reflected off the airborne particles at the first sensitivity, and saturation of the detector at the second sensitivity by detecting the radiation reflected off the airborne particles at the second sensitivity, wherein the second sensitivity is lower than the first sensitivity.

2. The monitoring device of claim 1, comprising a controller configured to control whether the at least one radiation detector detects the reflected radiation with the first sensitivity or the second sensitivity, and switch between a first state of operation that includes the first sensitivity and a second state of operation that includes the second sensitivity.

3. The monitoring device of claim 2, wherein the at least one radiation detector has a gain that corresponds to the sensitivity;

the controller is configured to control the sensitivity by controlling the gain; and the gain is based on a resistance associated with the at least one radiation detector and the controller is configured to control the sensitivity by controlling the resistance.

4. The monitoring device of claim 1, comprising an aperture associated with the at least one radiation detector, the aperture limiting an amount of the radiation that can reach the at least one radiation detector.

5. The monitoring device of claim 1, wherein a first one of the radiation sources emits light of a first wavelength;

a second one of the radiation sources emits light of a second wavelength; and the second wavelength is different than the first wavelength.

6. The monitoring device of claim 5, wherein the first one of the radiation sources emits one of red light and blue light; and the second one of the radiation sources emits one of ultraviolet light and infrared light.

7. The monitoring device of claim 1, wherein the at least one detector comprises a first detector having the first sensitivity and a second detector having the second sensitivity.

8. The monitoring device of claim 1, including an optical element positioned by at least one aperture that is associated with the radiation detector, the optical element having at least one of a shape and a focal length that selectively controls an amount of radiation detected by the detector.

9. A method of monitoring air quality, the method comprising:

emitting a plurality of types of radiation;

detecting radiation reflected off airborne particles;

determining a ratio of the types of radiation in the detected radiation;

determining a type of the particles reflecting the detected radiation based on the ratio;

determining a concentration of the particles reflecting the detected radiation including a first sensitivity for detecting the concentration within a first concentration range and a second sensitivity for detecting the concentration within a second, different concentration range;

selectively controlling use of the first sensitivity or the second sensitivity;

detecting the radiation reflected off the airborne particles at the first sensitivity;

determining whether a detector is saturated at the first sensitivity; and when the detector is saturated at the first sensitivity, detecting the radiation reflected off the airborne particles at the second sensitivity, wherein the second sensitivity is lower than the first sensitivity.

10. The method of claim 9, comprising switching between a first state of operation that includes the first sensitivity and a second state of operation that includes the second sensitivity, wherein a first detector has the first sensitivity and a second detector has the second sensitivity.

11. The method of claim 9, wherein detecting the radiation includes receiving radiation at a radiation detector that has a gain corresponding to the sensitivity; and selectively controlling the sensitivity comprises controlling the gain.

12. The method of claim 11, wherein the gain is based on a resistance associated with the radiation detector; and selectively controlling the sensitivity comprises controlling the resistance.

13. The method of claim 9, comprising:

determining whether a detector is saturated at the second sensitivity; and providing an indication when the detector is saturated at the second sensitivity.

14. The method of claim 9, wherein a first one of the types of radiation comprises light of a first wavelength;

a second one of the types of radiation comprises light of a second wavelength; and the second wavelength is different than the first wavelength.

15. The method of claim 9, wherein the detector comprises an optical element having a shape and a focal length and the method comprises selectively controlling an amount of radiation detected by the detector using at least one of the shape and the focal length of the optical element.

* * * * *